US007104467B2

(12) United States Patent
Crossdale et al.

(10) Patent No.: US 7,104,467 B2
(45) Date of Patent: Sep. 12, 2006

(54) DISPENSING APPARATUS WITH CODING MEANS

(75) Inventors: Garry William Crossdale, Ripley (GB); Brian Peter Onufryk, Spondon (GB); Dean Alan Percival, Kirby-In-Asnfield (GB)

(73) Assignee: JohnsonDiversey, Inc., Sturtevant, WI (US)

( * ) Notice: Subject to any disclaimer, the term of this patent is extended or adjusted under 35 U.S.C. 154(b) by 172 days.

(21) Appl. No.: 10/508,299

(22) PCT Filed: Mar. 4, 2003

(86) PCT No.: PCT/US03/06458

§ 371 (c)(1),
(2), (4) Date: Sep. 20, 2004

(87) PCT Pub. No.: WO03/080499

PCT Pub. Date: Oct. 2, 2003

(65) Prior Publication Data

US 2005/0133621 A1 Jun. 23, 2005

(30) Foreign Application Priority Data

Mar. 21, 2002 (EP) ..... 02252051

(51) Int. Cl.
*A62C 13/62* (2006.01)
*B05B 9/03* (2006.01)
*B05B 11/02* (2006.01)

(52) U.S. Cl. ..... 239/302; 239/312; 239/313; 239/329; 239/390; 239/379

(58) Field of Classification Search ..... 239/302, 239/312, 313, 315, 329, 390, 379; 53/253, 53/502, 503
See application file for complete search history.

(56) References Cited

U.S. PATENT DOCUMENTS 5,597,019 A * 1/1997 Thomas et al. ..... 141/18
5,651,398 A * 7/1997 Decker et al. ..... 141/18
5,832,972 A 11/1998 Thomas et al.
5,908,143 A 6/1999 Crossdale et al.
6,105,633 A * 8/2000 Pedersen et al. ..... 141/18
6,158,673 A * 12/2000 Toetschinger et al. ..... 239/305
6,279,836 B1 8/2001 Toetschinger et al.

FOREIGN PATENT DOCUMENTS

EP 0675073 A1 10/1995

* cited by examiner

*Primary Examiner*—Davis Hwu
(74) *Attorney, Agent, or Firm*—Gregory S. Bollis; James J. Sales; Neil E. Hamilton

(57) ABSTRACT

A liquid flow restrictor in the supply line of an eductor or other dilution or dispensing device has a rotatably mounted disc with opposite faces and a plurality of apertures or holes, which provide different flow restrictions between the faces, and a pair of flow conduits sealingly engaging against the faces, whereby on rotation of the member the zones are selectively brought into communication with the conduits to provide a desired flow restriction.

15 Claims, 4 Drawing Sheets

DISPENSING APPARATUS WITH CODING MEANS

CROSS-REFERENCE TO RELATED APPLICATIONS

None

STATEMENT REGARDING FEDERALLY SPONSORED RESEARCH OR DEVELOPMENT

None

FIELD OF THE INVENTION

The invention relates to the field of fluid dispensers, in particular manually operated dispensers of a type which include a reservoir and which for example dispense single shots of fluid from an outlet and into a container to be filled.

BACKGROUND OF THE INVENTION

In many organisations, for example in industry, in large kitchens and in large hotels where many rooms need to be cleaned regularly, small containers, such as easily portable bottles, are frequently refilled with cleaning and sanitising liquids from bulk containers held at a filling station. The dispenser is typically of the type described in EP 0868137. This describes a manually operated dispenser for dispensing measured single shots of fluid from a reservoir into a container positioned beneath the outlet. The containers being filled are typically labelled or coloured, in order to indicate the liquid which they should contain. There are obvious risks of errors here, that a liquid might be filled into a container for which it was not intended, particularly when many people frequently visit a filling station. Simple colour coding systems, whilst helpful, do not remove the possibility of human error.

Attempts have been made to overcome this problem by electronic automated filling systems, but these tend to be very complex, involving for example the reading of bar code labels. Such systems are expensive, they require expert set-up and maintenance and are prone to the occurrence of faults.

Document US-B1-6,279,836 describes a fluid dispenser in which the insertion of containers for which the dispenser is not intended is prevented by providing inwardly facing projections on the sides of a container receiving portion of the dispenser which engage complementary grooves in the side of the container as it is inserted into the dispenser for filling. Once the container is inserted to its full horizontal depth, it can be raised whereby the projections follow a "T" arm of the groove in the container side. Raising the container brings the container mouth to a position where it surrounds a filling nozzle, and at the same time the container mouth raises a slider which operates the fluid dispenser main valve.

SUMMARY OF THE INVENTION

The present invention seeks to provide a mechanically operated dispensing apparatus which is simple, dependable and low-cost, and which permits the dispensing of a specific liquid into a specific purpose-made container, whilst, at the same time, minimising the risk of inadvertent filling of containers intended for other liquids and the risk of spillages.

According to the present invention, there is provided a dispensing apparatus for delivering fluid to a container, the apparatus comprising:

container holding means for receiving in use a container having a fill port and a container identifier key, the container holding means including mechanical keying means arranged to permit a container with a predetermined identifier key to be completely inserted to a refill position in the container holding means, a dispensing outlet for delivering fluid to the fill port of a container at the refill position, fluid delivery means for delivering fluid to the dispensing outlet, an actuation member movable from a start position and operatively linked to the fluid delivery means to cause the fluid delivery means to deliver fluid in response to movement of the actuation member from the start position, a dispensing lock having a first position in which it blocks movement of the actuation member from the start position, and a second position in which it permits movement of the actuation member, release means for releasing the dispensing lock including a movable release member which is moved by a container, during its insertion into the refill position in the container retention means, so as to release the dispensing lock by bringing the dispensing lock to the second position, thus enabling fluid to be delivered.

The mechanical keying means preferably comprises one or more keying elements of predetermined shape and configuration, said elements being arranged for cooperation with a predetermined container identifier key having one of more keying elements of corresponding shape and configuration, thereby permitting the complete insertion of the container into the container holding means.

In this manner it is possible for the container holding means to allow the full and complete insertion of a certain type of container whilst blocking the insertion of other types, i.e. types which do not carry a specific identifier key. The specific container identifier key of a container intended for complete insertion into the container holding means is typically configured to cooperate in a mating manner with the mechanical keying means of the container holding means. Preferably either the mechanical keying means or the container identifier key includes an array of projections or an array of recesses or a combination of the two for cooperation with a corresponding mating array of projections and/or recesses on the other of these two parts.

Preferably the movable release member is arranged to be moved by a container during substantially complete insertion of the container into the container holding means. Preferably, the movable release member is located at an end region of a slot of the container holding means, the slot serving to receive a correctly inserted container, so that the container makes contact with and moves the movable release member at the end of its travel in the slot, during insertion.

Preferably the movable release means is a pivotally mounted bar member having a first portion arranged for interaction with an inserted container and a second portion arranged for interaction with the dispensing lock means. The movable release member is preferably arranged to move in a plane which is substantially in line with the insertion path of the container as it is inserted into the container holding means and in the case where the holding means takes the form of a slot, then substantially in line with the centre-line of the slot.

The movable release member is preferably mounted on a portion of the dispensing apparatus and is furthermore preferably located, in use, above a region in close proximity to the furthest point of travel into the apparatus of a fully inserted container.

The first portion of the movable release member is preferably located in close proximity to the container holding means. The first portion of the movable release member is more preferably located in close proximity to the furthest point of travel into the container holding means of a fully inserted container.

The movable release member has preferably an elongate shape and is more preferably substantially "T" shaped i.e. substantially in one plane. The movable release member is preferably mounted so as to extend substantially entirely in a vertical or near vertical plane. The first portion and the second portion are preferably at substantially opposite ends of the movable release member and the pivot which supports the movable release member is preferably positioned between the two ends. The movable release member preferably pivots about a substantially horizontal axis, the axis being preferably substantially perpendicular to the insertion direction of the container.

The dispensing lock means preferably has one movable locking member, or more preferably two movable locking members, which, in one position act to block movement of the actuation member i.e. plunger and thereby prevent actuation of the piston, and in a second position, permit the actuation member to move in response to an externally applied force.

Preferably the, or each of the, movable locking members is a pivotally mounted rocking arm which is capable of rotation between said first and second positions in response to movement of the release means.

The fluid delivery means preferably includes a working chamber and a piston means, the working chamber being selectively communicable with a fluid supply i.e. tank or reservoir within the apparatus and the dispensing passage. The working chamber can be of any convenient shape but will typically take the form of a cylinder or a cylinder of circular cross-section i.e. for cooperation with a circular piston.

Typically either the piston means or the boundary wall of the working chamber i.e. the cylinder, will be movable relative to the dispensing apparatus, whilst the other will be fixed. Either one or the other is then preferably actuable in response to movement of the actuation member to pressurise fluid in the working chamber for delivery to the dispensing passage.

The actuation member is preferably at least partially exposed to the exterior of the apparatus. The actuation member is preferably a plunger which is arranged for movement independently of the piston (or working chamber/cylinder, cylinder wall, whichever is movable), said actuation member being movable in response to an externally applied force i.e. when depressed by an operator, to move the piston and thereby pressurise the fluid in the working chamber and deliver fluid from the dispensing passage.

The actuation member may take other forms such as a button or lever to which force can be applied by an operator.

It is envisaged that the present invention will be used with any suitable shape, size and type of container with a port suitable for refilling the container and a container identifier key suitable for use with the present dispensing apparatus. It is also envisaged that the containers for use with the dispensing apparatus of the present invention may also include aspects of other recognition systems such as colour, shape etc. to visually assist the operator before he makes an attempt at inserting a container into the dispensing apparatus.

INTRODUCTION OF THE DRAWINGS

An embodiment of the invention will now be described by way of example, with reference to the accompanying drawings, in which:—

FIG. 6 is a top view of the apparatus of FIG. 1 after the plunger has been pushed in.

DESCRIPTION OF THE PREFERRED EMBODIMENT

Figure 1:
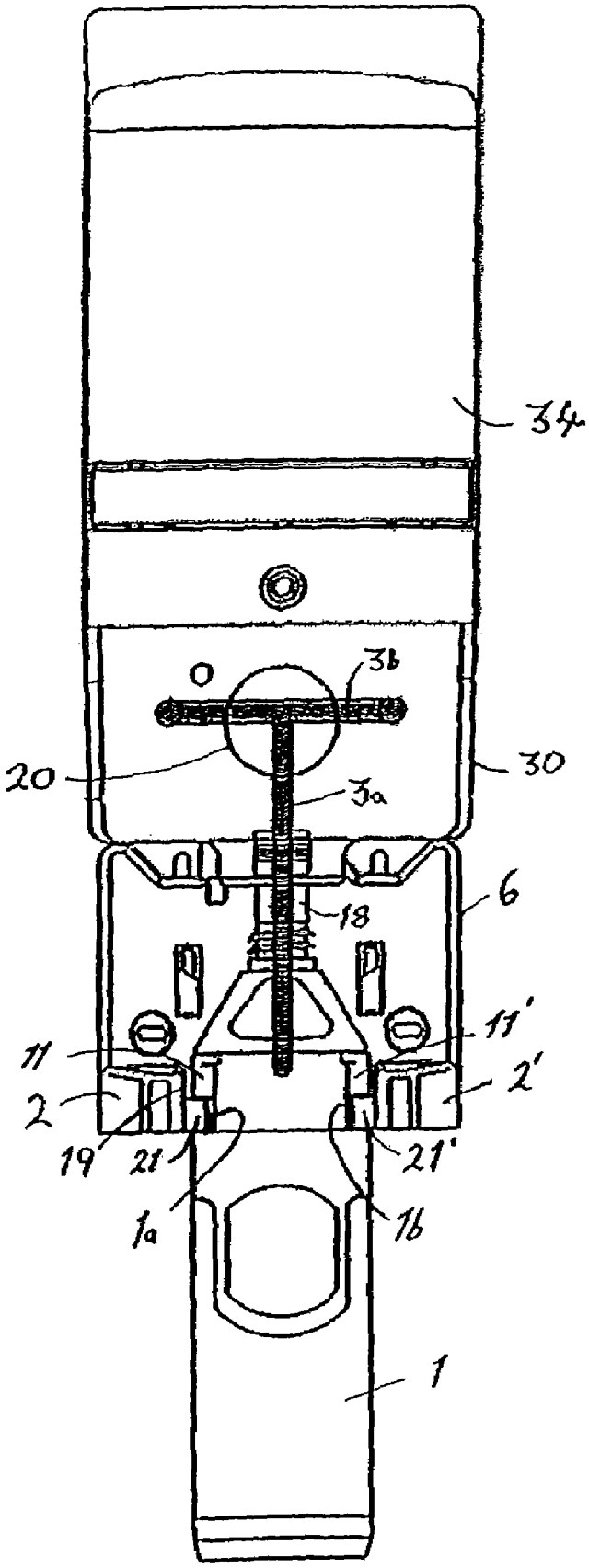
FIG. 1 is a front view of the dispensing apparatus embodying the invention, in which a container has been inserted.

The fluid dispensing apparatus shown in FIGS. 1 to 7 has a fixed frame structure in the form of an enclosed housing 30, 34 and a bottle retainer 2 including a back plate 6 which is either joined or unitary with the housing 30, 34. The housing 30, 34 and bottle retainer 2 are shown mounted on a vertical wall 40, e.g. a building wall. The housing generally has a top box 34 which carries a removable or refillable reservoir (not shown) of fluid to be dispensed, and a lower housing portion 30 in which the dispensing mechanism is located. The lower housing portion 30 is located above a dispensing outlet 18, through which fluid being dispensed is delivered into the filling port 13 of a container located beneath the outlet 18.

The reservoir of fluid to be dispensed (not shown) is arranged within the top box 34 and passage 33 is arranged between the reservoir and the dispensing outlet 18. Suitable piping arrangements, including valves, are shown in EP-A-868137. A pump comprising a cylinder 26 and piston 25, which together define a working chamber 29, is connected through a common inlet/outlet passage 32 to passage 33. The piston 25 is slidably arranged within the cylinder 26 where it is capable of reciprocal movement. The piston 25 is attached to a piston stem 24 of a piston sleeve 23. The piston sleeve 23 slidably surrounds the cylinder 26.

The piston stem 24 is an axial projection attached to the centre of a radially extending flange 23*a* within the piston sleeve 23. The flange 23*a* is located towards the outer end of sleeve 23 and is attached to the inner wall of the sleeve.

A plunger 20 is slidably arranged on the outside of the piston sleeve 23, towards the outer end thereof. The piston sleeve 23, with its piston stem 24, are slidable relative to the plunger 20.

As can be seen in FIGS. 4 to 7, the plunger 20 is a cup-shaped component with a cylindrical portion, an end cap 20*a*, a bearing surface 20*b* at one end and a flange 22 at its other end. The plunger 20 is slidingly mounted on the outside of piston sleeve 23 and is also arranged to slide within an aperture 30*d* in the front wall of the housing 30.

Figure 4:
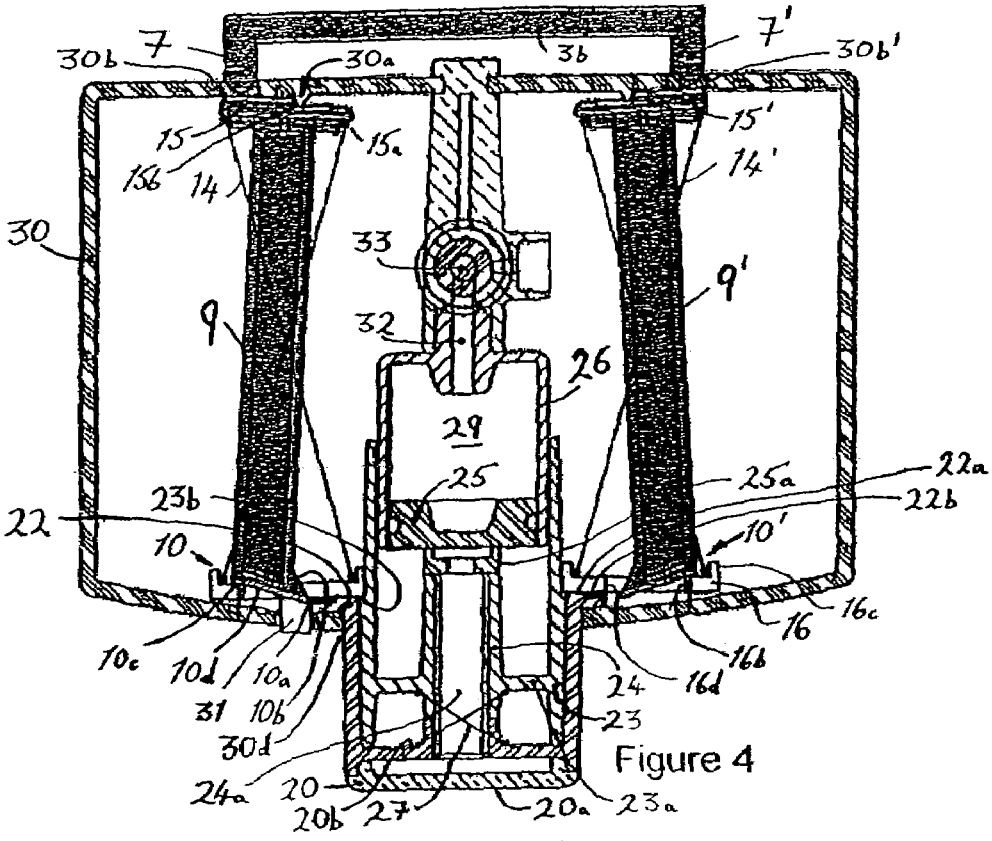
FIG. 4 is a top view of the apparatus of FIG. 1 in horizontal section and in its "stand-by" position.

The plunger flange 22, being of greater diameter than the aperture 30*d* ensures that the plunger cannot be removed from the front wall of the housing and therefore serves to define an outwards end position of the plunger 20 when this is not depressed into the dispensing apparatus (e.g. as in FIG. 4). The plunger flange 22 is also provided with indent portions 22*b*, 22*b*', at its radially outward edge, which face inwardly i.e. in the general direction of the working chamber 29 of the apparatus. The flange indent portions 22*b*, 22*b*' extend to the outer edge of the flange are arranged to receive the inclined nose portions 10*a* of respective rocking arms 9, 9' described below.

The bottle retainer 2 consists of the two forwardly projecting arms 2, 2' which are attached to the back plate 6, forming a slot-like opening 19 into which a bottle 1 can be inserted. The arms 2, 2' carry rails 21, 21' which are arranged to cooperate with corresponding slots 1*a*, 1*b* in the bottle 1.

The bottle retainer 2 carries mechanical keying means in the forms of an arrangement of projections at the base of slot-like opening 19 of retainer 2 for cooperation with an appropriately keyed bottle, as for example described in greater detail in the European patent application EP0675073. A bottle which is intended to be insertable into the retainer 2 carries recesses in positions corresponding to the projections at the bottom of opening 19, whereon other bottles cannot be fully inserted into the base of opening 19, which means they cannot reach the refill position. The recesses on the bottle therefore serve as the bottle identifier key and whether or not this matches the projections at the base of opening 19 determines whether a particular bottle type can be fully inserted into a particular dispenser.

Alternatively, the rails 21, 21' can each carry a shaped formation which serves as the mechanical keying means of the retainer 2. In this case a bottle 1 which is intended to be insertable into the retainer 2 carries at the bottom of the slots 1*a*, 1*b* formations intended for mating cooperation with the mechanical keying formations of arms 2, 2'. The mechanical keying formations can be designed to allow the insertion into the retainer of a particular type of bottle which carries a corresponding mating container identifier key and to block the insertion of other bottles which do not carry the appropriate identifier key.

Figure 2:
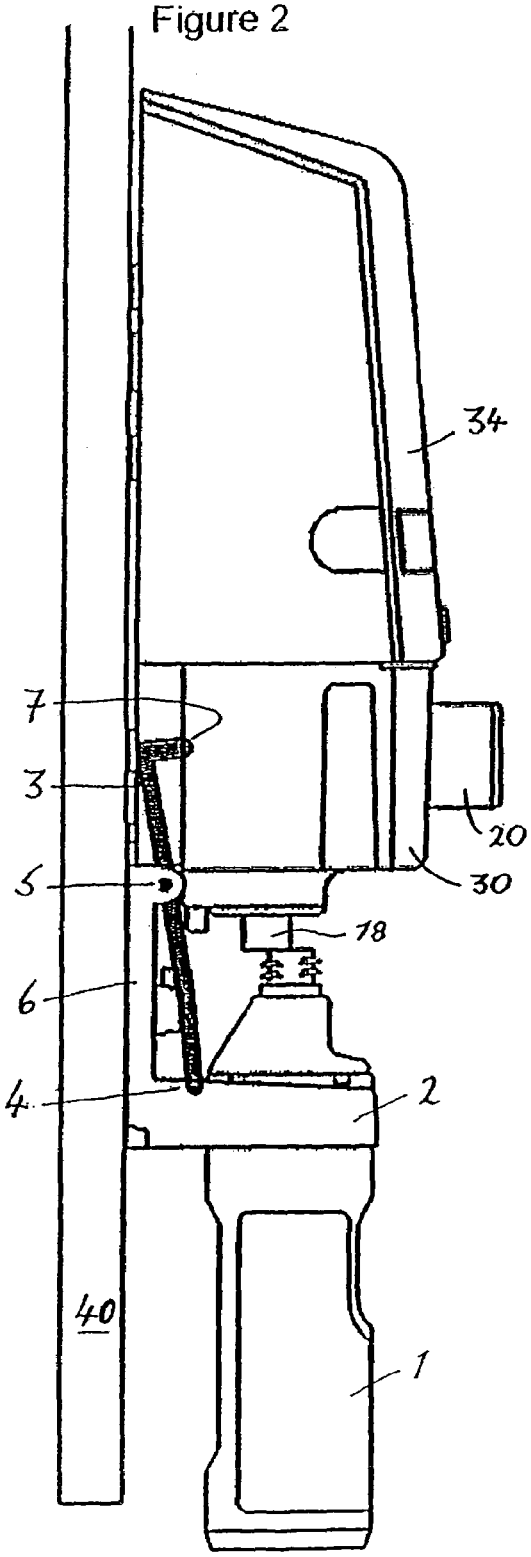
FIG. 2 is a side view of the dispensing apparatus of FIG. 1 with a container which is not fully inserted.
Figure 3:
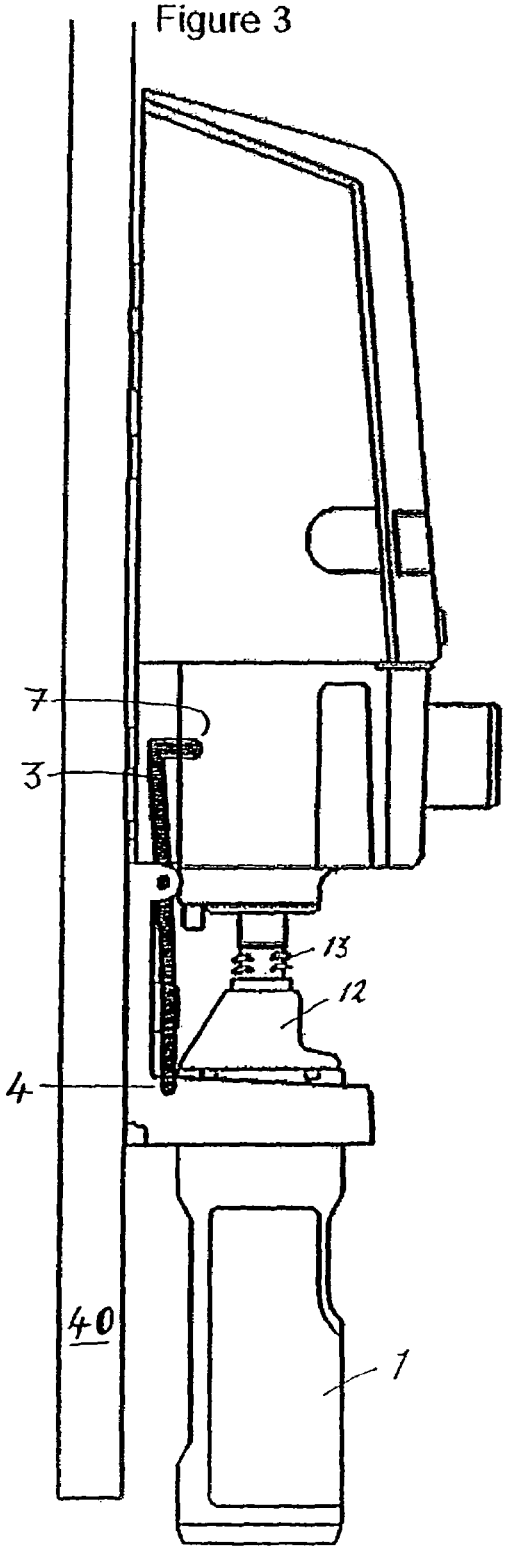
FIG. 3 is a side view of the dispensing apparatus of FIG. 1, with a fully inserted container.

FIG. 2 shows a bottle retainer 2 receiving a bottle which includes the specific identifier key which enable it to cooperate with the mechanical keying formation of the retainer 2 and become fully inserted in the retainer 2 as illustrated in FIG. 3.

As can be seen from FIGS. 2 and 3, the bottle 1 is inserted into the dispensing apparatus in a generally horizontal direction as it moves along the guide rails 21, 21'. As illustrated in FIG. 3, the bottle 1 comes to rest in its final insertion position with its filling port 13 directly beneath the dispensing outlet 18. The retainer 2, also includes latches, pips or beads (not shown) which help to secure the bottle in its fully inserted final position of travel with the dispensing apparatus by engaging with corresponding pips or beads in slots 1*a*, 1*b* on the bottle. Alternatively, a pair of lugs on the bottle may drop down into respective grooves on rails 21, 21' as shown in EP0675073.

A substantially "T" shaped movable release member 3 is illustrated in FIG. 1 and in two operating positions in FIGS. 2 and 3 respectively. As can be seen from the figures, the movable release member is mounted on a pivot 5 and extends partially into the slot 19 between the arms 2, 2'. The movable release member 3 has a first contact point 4 at its lower end which is located, in use, in the insertion path of the bottle 1. As the bottle reaches nearly to its fully inserted position, it makes contact with the contact point 4 of the movable release member 3. As insertion continues, further movement of the bottle displaces the contact point 4 thereby deflecting the release member 3 from its rest position, which is inclined to the vertical as illustrated in FIG. 2, to a releasing position, where it is in a substantially vertical orientation, as illustrated in FIG. 3.

As can be seen in FIGS. 2 and 3, the pivoting axis of pivot 5 is substantially horizontal and is substantially perpendicular to the insertion direction of the bottle 1. Moreover, the lower portion of 3*a* of the release member 3 is substantially aligned with the centre line of the slot 19. This means that the front portion of a bottle 1 having a rounded cross section, will confront the contact point 4, as illustrated in the Figures. This enables the presence of a fully and correctly inserted bottle to be detected by the release member 3 in a simple and reliable manner. The shape of the release member 3 and its position towards the centre of the dispensing apparatus makes it more difficult for an operator who has not inserted the correct bottle for this retainer 2 to depress and therefore activate the release member. Further guard means (not shown) e.g. in the form of walls on either side of release member 3 are also provided to hinder access by an operator to the release member 3 and therefore make it more difficult to operate the dispenser without the correctly keyed bottle having been fully inserted.

The horizontal upper portion 3*b* of the member 3 has two end portions 7, 7' between which the approximately vertical lower portion 3*a* is attached to form the "T" shape configuration. As can be seen in FIGS. 4 to 7, end portions 7, 7' project substantially laterally from the upper portion 3*b* and into apertures 30*b* in the rear of the lower housing portion 30. The end portions 7, 7' serve as contact points which contact respective recesses (not shown) on heels 15, 15' at the end of two respective rocking arms 9, 9'. The rocking arms 9, 9' are disposed substantially horizontally, one at either side of the plunger/piston/ cylinder assembly, and each has a latch 10, 10' which projects inwardly (towards the plunger) at an inclined nose portion 10*a* thereof. The nose portion has the end surface 10*d* of the latch 10, 10' to one side and facing outwards (relative to the centre of the dispenser) and to the other side an inward facing surface 10*b* which is inclined to the axis of its arm 9. The end surfaces 10*d* of latches 10, 10' are oblique relative to the longitudinal direction of the arms 9, 9' and therefore also to the rear faces of the heels 15, 15' and are furthermore also provided with flat portions 10*c* which extend substantially perpendicular to the longitudinal direction of the arms 9, 9' and which are arranged for engagement with latch plate bearing surfaces 16*a* to be described below. The heels 15, 15' of the rocking arms 9, 9' are arranged to pivot on pivots 30*a* of the housing 30 so as to be capable of moving in a substantially horizontal plane. Pivots 30*a* are in the form of elongated ridges 30*a*, extending substantially vertically, for co-operation with respective elongate indentations 15*b* of heels 15, 15'.

As can be seen from the figures, the pivots 30*a* of the heels 15, 15' are not aligned with the centres of the heels 15, 15' but are offset to one side, i.e. inwardly. With no bottle inserted, then under the influence of compression springs 14, 14' which are arranged to act on the heels 15, the rocking arms 9, 9' will adopt the rest position illustrated in FIG. 4, with the rocking arms 9, 9' slightly outwardly inclined.

Also illustrated is a substantially annular latch plate 16, extending substantially perpendicular to the plunger/ piston/ cylinder axis, and having apertures 16*b*, the bearing surfaces 16*a* against which the compression spring 14, 14' acts and a rim 16*c* which maintains the position of the springs 14, 14' on the latch plate. The latch plate 16 is mounted against shoulder 23*b* on the outer surface of piston sleeve 23. The springs 14, 14' are normally under compression so as to tend to push the latch plate 16 away from the associated heels 15, 15'. The plunger 20 acts on the piston sleeve 23 and latch plate 16 so that, when the plunger 20 is pushed into the apparatus, it moves the piston sleeve 23/latch plate 16 towards the heels 15, 15' over the outside of cylinder 26.

Figure 5:
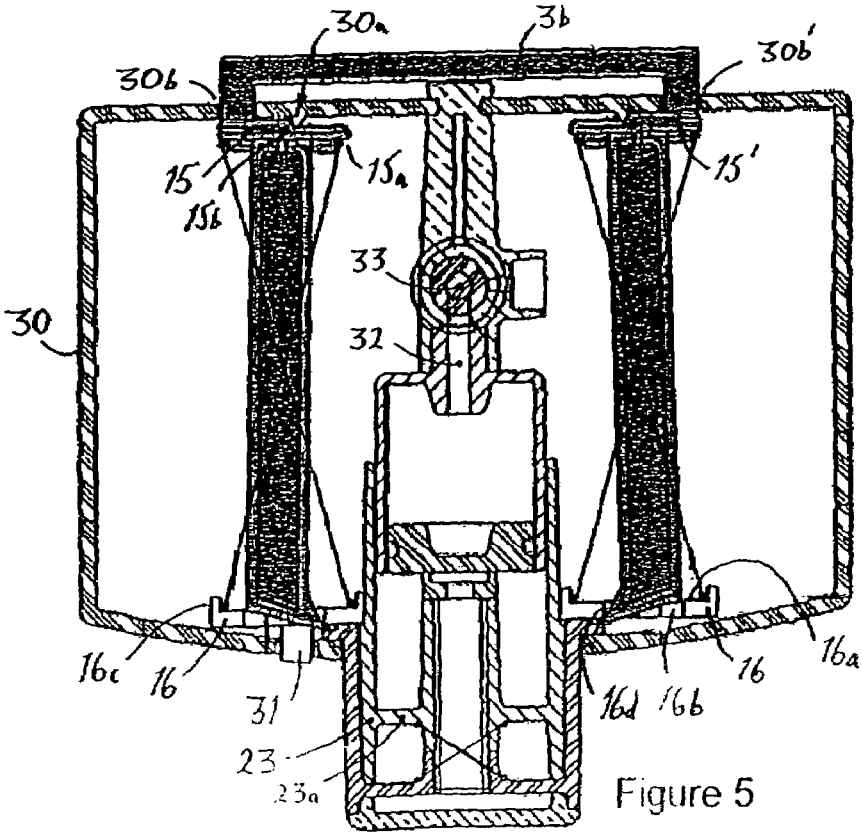
FIG. 5 is a top view of the apparatus of FIG. 1 when a container is fully inserted.
Figure 6:
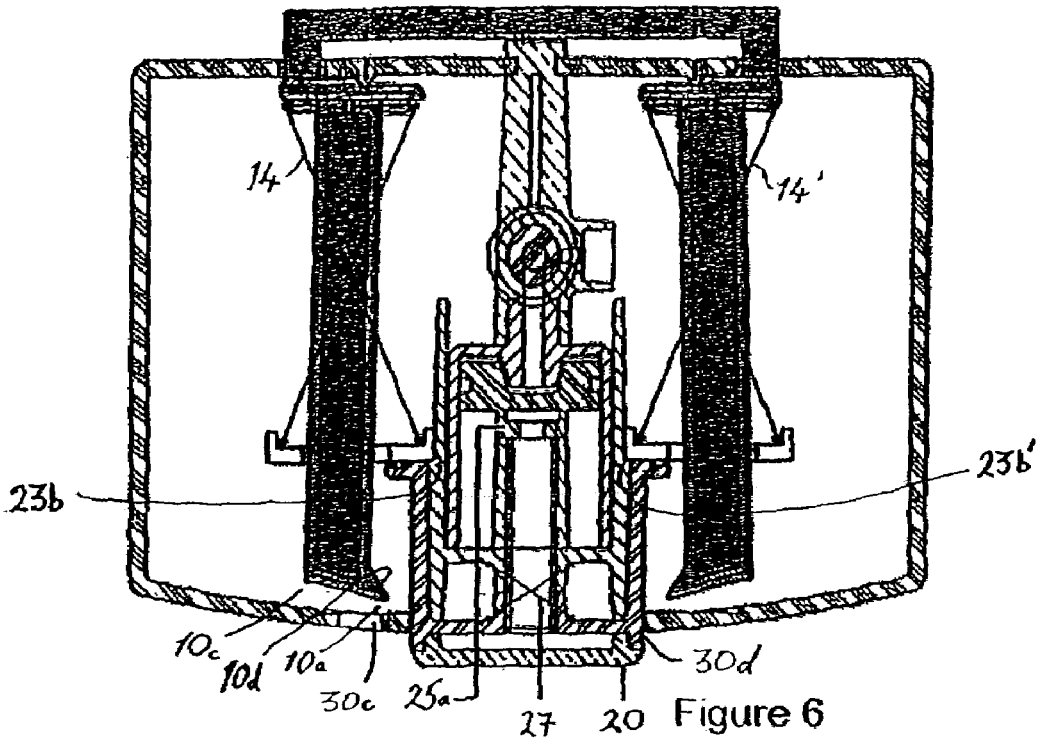

The apertures 16*b* are large enough to receive the end portions of the latches 10, 10' of the rocking arms 9, 9'. This permits the latch plate when moved by the plunger in line with the plunger/piston/ cylinder axis to pass over the rocking arms 9, 9', when the latches 10, 10' of the rocking arms are in alignment with latch plate apertures 16*b*. The plunger 20 is arranged to act, through the plunger flange face 22*a*, against the latch plate 16 (as shown in FIGS. 4, 5, 6). The apertures 16*b* allow for movement of the piston sleeve 23/latch plate 16 over the outside of cylinder 26, said apertures passing over the rocking arms 9, 9', as the plunger 20 is depressed. At the inner side of each aperture 16*b*, there is an edge 16*d*, arranged relative to the rocking arm be in abutment with an inclined nose portion 10*a* of the rocking arm, when the plunger is in the outer position (as in FIG. 5). The edge 16*d* thus acts to hold the inclined nose portion 10*a* of the rocking arm into the position in which it is substantially radially aligned with the outside of the plunger flange 22, it being understood that the flange 22 extends substantially the same distance outwardly as the edge 16*d* at the inner side of the latch plate aperture 16*b*.

The springs 14, 14' act to push the piston 25 out of the piston cylinder 26 (through latch plate 16, shoulder 23*b*, sleeve 23, stem 24), so as to draw a shot of liquid from the reservoir, through passages 33 and 32, and into the working chamber 29 bounded by piston 25 and cylinder wall 26.

Between the flange 23*a* of the piston sleeve 23 and a bearing surface 20*b* of the plunger is arranged a plunger compression spring 27 which acts so as to urge the plunger 20 away from the piston sleeve 23 and therefore piston 25. This spring 27 is, however, weaker than the springs 14, 14' so that spring 27 is not able to push the piston 25 against the force of the springs 14, 14'.

The operation of the dispensing apparatus is as follows. FIG. 4 shows the dispensing apparatus in its "standby" condition in which a bottle 1 to be refilled has not been fully inserted into the dispensing apparatus (e.g. as is shown in FIG. 2). In this condition, the flat portions 10*c* at the end of rocking arms 9, 9' act on the bearing surface 16*a* of the latch plate 16 to lock the latch plate in its forward position and hold the plunger flange 22 against the front wall of the housing 30. Thus, in this condition, it is not possible for an operator to depress the plunger 20.

FIG. 5 illustrates the dispensing apparatus in its "ready to dose" condition. Here, as illustrated in FIG. 3, a bottle 1 has been fully and correctly inserted in cooperation with the mechanical key of the retainer 2 and into its final position in the retainer. The moveable release member 3 has been pushed into a second position (as in FIG. 3). The second position can also be seen in FIG. 5 where the top portion 3*b* of the release member 3 has moved closer to the rear wall of the housing 30, pushing end portions 7, 7*a* of the release member through respective apertures 30*b*, 30*b'* in the rear wall and into respective recesses of heels 15, 15'. The end portions 7, 7' act on respective outer sides of heels 15, 15' so that the pivoting axis of the heels changes from pivots 30*a* to the point of contact between end portions 7, 7' and heels 15, 15'. The force of springs 14, 14' acting on the new offset pivoting axis 7, 7' of heels 15, 15' causes the rocking arms 9, 9' to move inwardly compared to the standby condition, as shown in FIG. 5. In this condition, the flat portions 10*c*, at the end of the rocking arms, have disengaged the latch plate 16 and the latches 10, 10' at the end of rocking arms are substantially aligned with the apertures 16*b* in the latch plate. Consequently, in this condition, the plunger can be depressed by an operator into the dispensing apparatus whereby the inclined nose portions 10*a* of the latches 10, 10' are free to slide across the inner edge 16*d* of the latch plate apertures and similarly across the outer edge of plunger flange 22, as the plunger is depressed. Inclined nose portions 10*a* are formed in such a manner, i.e. with a rounded tip or with a tip inclined to the axis of the rocking arms, such that they do not engage the flange indent portions 22*b*, 22*b'* when the plunger flange 22 and latch plate 16 are in abutment (as shown in FIG. 5). In other words, as the plunger is depressed, the nose portions 10*a* of latches 10 cannot travel sufficiently radially inwards, into the indent portions 22*b*, 22*b'*, to engage the bottom of the indent portions and block movement of the plunger.

Incidentally, a readiness indicator 31 mounted on one of the latch plate 16, protrudes forwardly through an aperture 30*c* in the front wall of the housing, so that an operator can see that the dispenser is ready to dispense.

When the operator depresses the plunger 20, the plunger pushes the piston sleeve 23, the latch plate 16, the piston stem 24 and piston 25 into the dispenser, thus delivering the contents of the working chamber 29 through the inlet/outlet passage 32 to the dispenser outlet 18.

FIG. 6 shows the maximum depression of the plunger into the dispenser, where the piston 25 has reached the back wall 26 of the cylinder, thus having dispensed the contents of the working chamber. The action of depressing the plunger takes place against the force produced by the springs 14, 14' and as soon as the operator stops applying a force to the plunger 20, i.e. after it has reached its final position of travel, these springs 14, 14' start to move the piston 25 away from the cylinder back wall by a force applied through latch plate 16 to shoulder 23*b* on the outer surface of the piston sleeve 23. In this way, the spring force of springs 14 is transferred through piston sleeve 23 and piston stem 24 to the piston 25 and as the piston moves back from its end position it draws in liquid through the inlet/outlet passage 32 from the fluid supply reservoir and into the working chamber 29.

At the same time, whilst the working chamber 29 begins to fill when the operator is no longer depressing plunger 20, the plunger quickly moves back out of the dispenser under the force produced by plunger spring 27. Whilst spring 27 is weaker than the main springs 14, it is sufficiently strong to relatively quickly move the plunger away from the end of piston sleeve 23. This contrasts with the relatively slower movement of the piston sleeve out of the dispenser under the force of main springs 14 as these springs are working to refill the working chamber 29. As the plunger 20 reaches its final outward position of travel under the influence of plunger spring 27, then the plunger flange 22 will make contact with and pass over latches 10, 10', nudging them slightly outwards in the process. The fully outward position of the plunger is illustrated in FIG. 7 and as can be seen, the latches 10, after being temporarily displaced outwardly as the flange 22 passed by, have moved back inwardly along indent portions 22*b*, 22*b'* in the end surface 22*a* of the flange, i.e. further radially inwardly than is possible when the latch plate 16 is abutting flange 22.

As the indent portions 22*b*, 22*b'* only extend a certain distance inwards from the outer edge of the flange 22, they therefore include an end wall. As the latches 10, 10' move back inwards, once the flange 22 has passed, then they move down the indent portions 22*b*, 22*b*' until stopped from travelling further inwards by the position adopted by heels 15. In this condition, which is illustrated in FIG. 7, the force from the springs 14, 14' on heels 15, 15' pivoting on ends 7, 7' of release member 3 tend to move the rocking arms 9 and therefore latches 10 inwards. Further movement inwards is opposed by ridges 30*a* abutting the rear wall of heels 15, 15' (ridges 30*a* are not acting as pivots in this condition).

Figure 7:
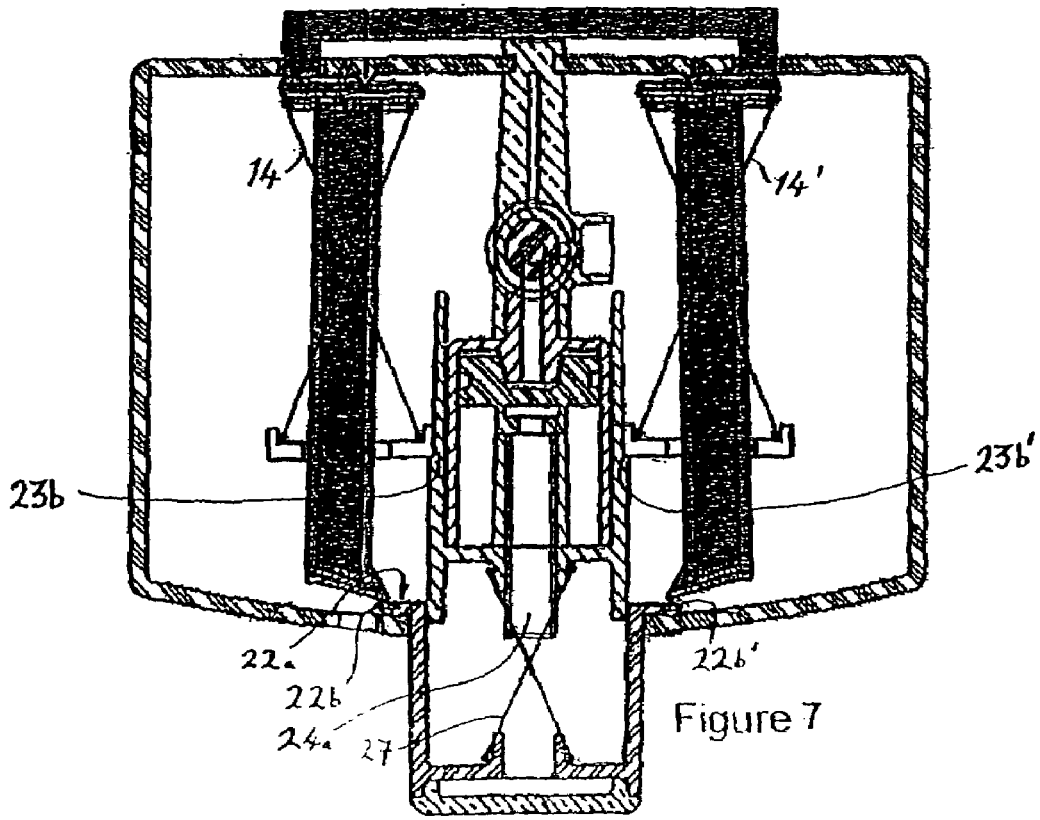
FIG. 7 is a top view of the apparatus of FIG. 1 where the plunger has retreated to its starting position and the cylinder is beginning to refill.

From the condition illustrated in FIG. 7, where the plunger is in its fully outward position and the piston 25, piston sleeve 23 and latch plate 16 are slowly moving as the working chamber 29 is filling, the latch plate 16 approaches the end face 22*a* of the plunger flange 22. As the latch plate 16 reaches the flange 22, it firstly comes into contact with the inward facing portions 10*b* of respective latches 10, 10', nudging the latches 10, 10' outwardly so that nose portions 10*a* no longer engage indent portions 22*b*, 22*b*' and the rocking arms 9, 9' assume again the position generally illustrated in FIG. 5. Here the nose portions 10*a* of latches 10, 10' rest at the position of the inner edge 16*d* of apertures 16*b*.

If the bottle 1 is left in its fully inserted position, then it would be possible for the operator to depress, once again, the plunger and dispense another dose of fluid into the bottle. However, if the bottle 1 is moved out of the dispenser, i.e. backwards from its fully inserted position, then the condition of the dispenser will change from that which is illustrated in FIG. 3 to a condition such as the one illustrated in FIG. 2. When this happens, then the end portions 7, 7' of the release member no longer act as pivots for heels 15, 15' and with the heels pivoting on ridges 30*a*, the rocking arms 9, 9' and therefore latches 10, 10' then move outwardly under the influence of springs 14, 14'. Once this happens, the flat portions 10*c* of the rocking arms move out of the latch plate apertures 16*b* to a position where they oppose or latch against the bearing surfaces 16*a* i.e. the inner facing surface, of the latch plate 16 to assume once again the condition generally illustrated in FIG. 4. The dispenser is therefore back in its standby condition and the plunger cannot be depressed until a bottle i.e. a bottle carrying the correct identifier key for this dispenser, is once again fully inserted into the retainer 2.

The invention claimed is:

1. A dispensing apparatus for delivering fluid to a container, the apparatus comprising:

container holding means for receiving in use a container having a fill port and a container identifier key, the container holding means including mechanical keying means arranged to permit a container with a predetermined identifier key to be completely inserted to a refill position in the container holding means, a dispensing outlet for delivering fluid to the fill port of a container at said refill position, fluid delivery means for delivering fluid to the dispensing outlet (18), an actuation member movable from a start position and operatively linked to the fluid delivery means to cause the fluid delivery means to deliver fluid in response to movement of the actuation member from said start position, characterized by a dispensing lock having a first position in which it blocks movement of the actuation member from said start position, and a second position in which it permits movement of the actuation member, and release means for releasing the dispensing lock including a movable release member which is moved by a container, during its insertion into the refill position in the container holding means, so as to release the dispensing lock by bringing the dispensing lock to said second position, thus enabling fluid to be delivered.

2. A dispensing apparatus according to claim 1, wherein said dispensing lock has at least one movable locking member which, in a first position, is capable of blocking movement of the actuation member, and in a second position, permits the actuation member to move.

3. A dispensing apparatus according to claim 2, wherein the or each said movable locking member is a pivotally mounted rocking arm which is arranged to rotate between said first and second positions in response to movement of the release means.

4. A dispensing apparatus according to claim 3, wherein the movable release means is a pivotally mounted bar member having a first portion arranged for interaction with an inserted container and a second portion arranged for interaction with the dispensing lock.

5. A dispensing apparatus according to claim 3, wherein the fluid delivery means includes a working chamber and a piston, the working chamber being communicable with a fluid supply means and the dispensing passage.

6. A dispensing apparatus according to claim 3, wherein the actuation member is at least partially exposed to the exterior of the apparatus for direct manual operation by an operator.

7. A dispensing apparatus according to claim 2, wherein the movable release means is a pivotally mounted bar member having a first portion arranged for interaction with an inserted container and a second portion arranged for interaction with the dispensing lock.

8. A dispensing apparatus according to claim 2, wherein the fluid delivery means includes a working chamber and a piston, the working chamber being communicable with a fluid supply means and the dispensing passage.

9. A dispensing apparatus according to claim 2, wherein the actuation member is at least partially exposed to the exterior of the apparatus for direct manual operation by an operator.

10. A dispensing apparatus according to claim 1, wherein the movable release means is a pivotally mounted bar member having a first portion arranged for interaction with an inserted container and a second portion arranged for interaction with the dispensing lock.

11. A dispensing apparatus according to claim 10, wherein the fluid delivery means includes a working chamber and a piston, the working chamber being communicable with a fluid supply means and the dispensing passage.

12. A dispensing apparatus according to claim 10, wherein the actuation member is at least partially exposed to the exterior of the apparatus for direct manual operation by an operator.

13. A dispensing apparatus according to claim 1, wherein the fluid delivery means includes a working chamber and a piston, the working chamber being communicable with a fluid supply means and the dispensing passage.

14. A dispensing apparatus according to claim 13, wherein the actuation member is at least partially exposed to the exterior of the apparatus for direct manual operation by an operator.

15. A dispensing apparatus according to claim 1, wherein the actuation member is at least partially exposed to the exterior of the apparatus for direct manual operation by an operator.

* * * * *